United States Patent [19]

Ransbottom

[11] 4,149,954

[45] Apr. 17, 1979

[54] METAL RECOVERY APPARATUS

[76] Inventor: Terry L. Ransbottom, 10815 State Rte. 161, Mechanicsburg, Ohio 43044

[21] Appl. No.: 827,089

[22] Filed: Aug. 23, 1977

[51] Int. Cl.[2] ..... C25C 7/00

[52] U.S. Cl. ..... 204/272; 204/109; 204/149; 204/271; 204/275

[58] Field of Search ..... 204/109, 149, 152, 272, 204/275, 271

[56] References Cited

U.S. PATENT DOCUMENTS

| | | | |
|---|---|---|---|
| 3,702,814 | 11/1972 | Mandroian | 204/109 X |
| 3,715,299 | 2/1973 | Anderson et al. | 204/109 X |
| 3,728,235 | 4/1973 | Cooley et al. | 204/109 |
| 3,728,244 | 4/1973 | Cooley | 204/109 X |
| 3,959,110 | 5/1976 | Burgess | 204/109 X |
| 3,964,990 | 6/1976 | Woyden | 204/275 |
| 4,028,212 | 6/1977 | Bowen et al. | 204/272 |

*Primary Examiner*—Arthur C. Prescott
*Attorney, Agent, or Firm*—Jerome P. Bloom

[57] ABSTRACT

A system, method and apparatus particularly useful in connection with film processing and like systems provides for the separation and removal of metal from a solution such as a fixing bath. The separator apparatus comrises a housing containing anode and cathode elements positioned concentric to each other and to a delivery tube. A distributor means, at the discharge end of the delivery tube, has no moving parts and is formed to induce a swirling helical flow of the metal bearing solution as it is directed thereby to the space between the anode and cathode elements of the separator. A simple block type manifold facilitates the circulation and recirculation of the metal bearing fluid within the separator and the delivery thereby of an essentially "clean" reusable fluid the metal content of which has been removed and left as a relatively hard plating on the cathode element. Contributing to the highly efficient operation of the separator is an arrangement whereby a first pump induces a positive flow of the metal bearing fluid from its source while a second pump commonly connected therewith to the separator manifold induces a recirculation of portions of the fluid under conditions producing a substantial pressure head providing that the character and rate of flow between the anode and cathode elements in such to insure a maximal separation of the metal content and in a form and condition thereof which gives it maximum value.

The invention apparatus features a simple interconnection of the separator parts which permits withdrawal of the cathode element without loss of fluid from the housing in which the cathode element is embodied. A further feature of the invention is a provision for connecting the anode and cathode elements to a source of power at points external to the separator housing and at locations free of circulated fluid.

22 Claims, 7 Drawing Figures

FIG-1
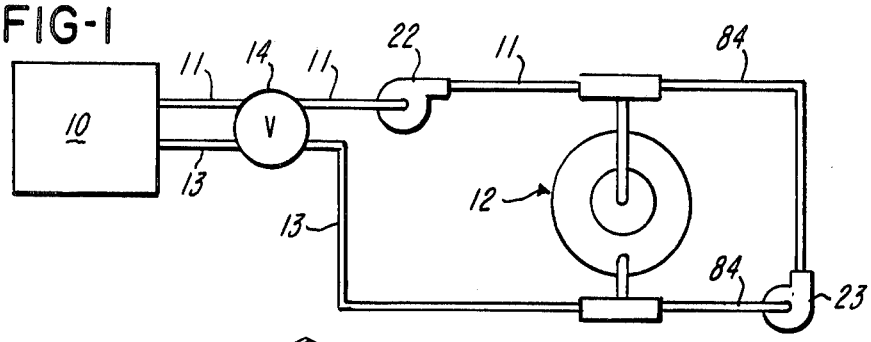
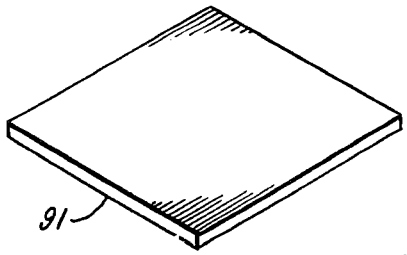
FIG-2
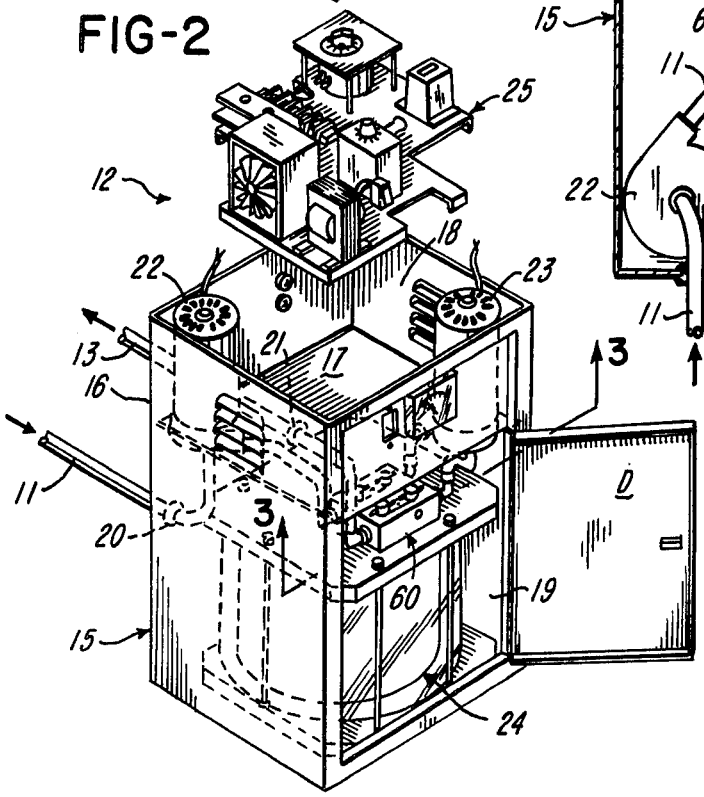
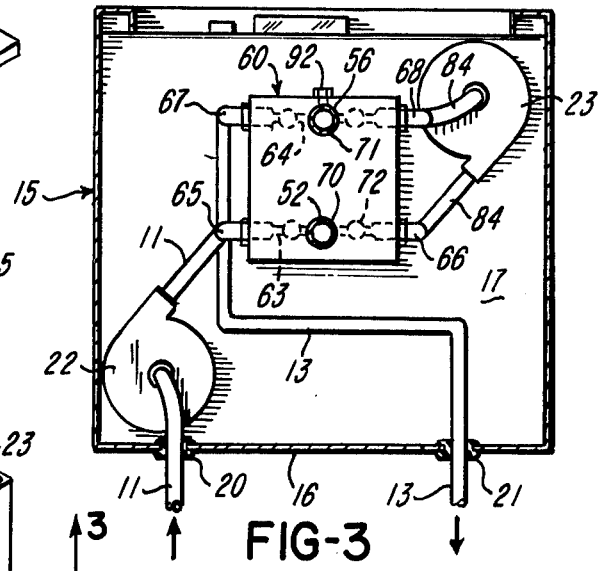
FIG-3

FIG-5
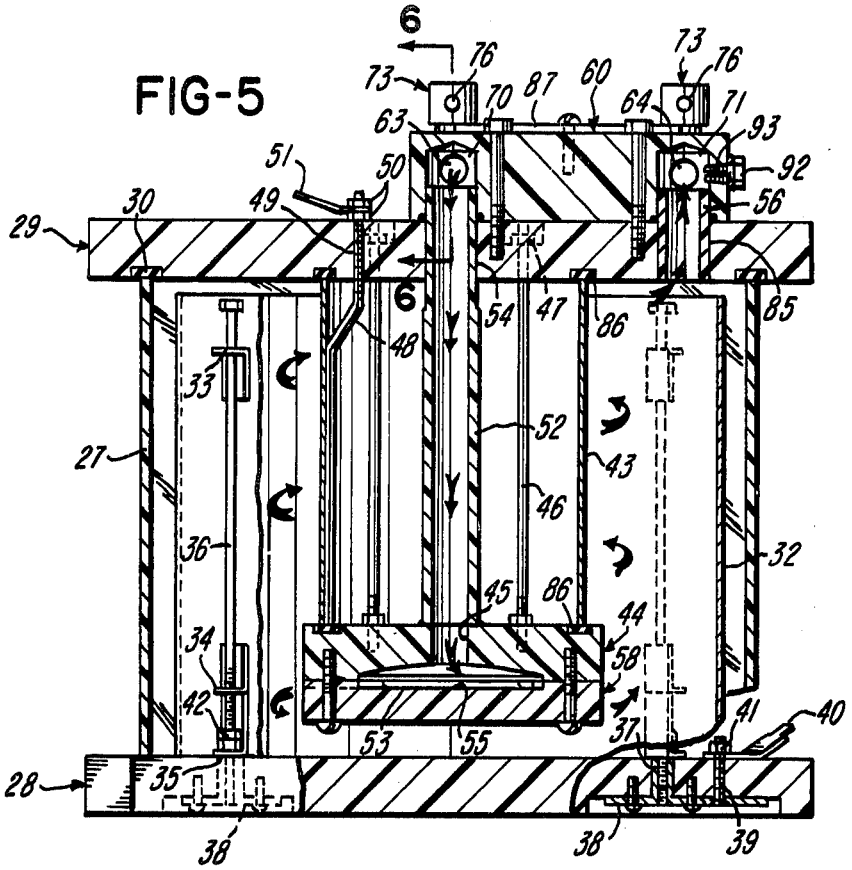
FIG-6
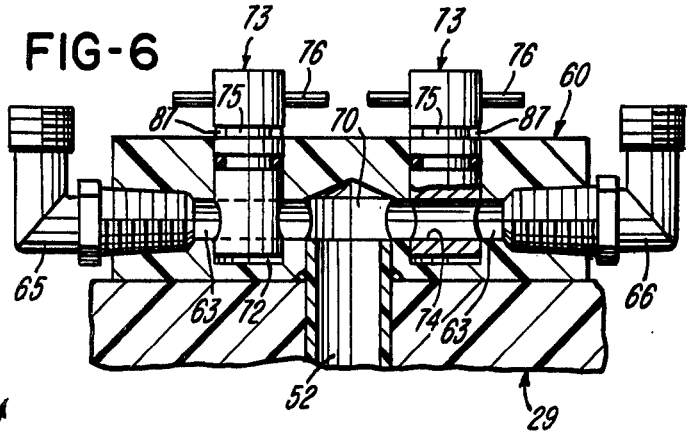
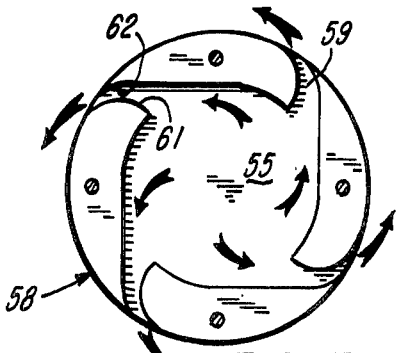
FIG-7

METAL RECOVERY APPARATUS

BACKGROUND OF THE INVENTION

This invention relates to improvements in apparatus using a principle of electrolytic action to recover metal from a solution. It has particular advantage for use in recovering silver in a film processing installation and it will be so described, but only by way of illustration and not by way of limitation.

The X-ray departments of hospitals, for example, have extensive film processing operations. During the development of the films taken in such departments, silver freed from the film by the action of the applied X-rays is washed from the film by the fixer solution, of which it then becomes a part. As the silver content increases, the fixer solution tends to rapidly deteriorate and require early replacement. For this reason, as well as the potential value of the silver content, it is the practice to make an effort to extract the silver from the solution.

Systems used for the recovery of silver from a fixer solution as known in the prior art are relatively inefficient and the silver recovered thereby is often in a less than satisfactory condition. To the extent known, the prior art silver recovery systems require the use of a large motor and pump to draw the metal bearing solution from a fixing tank and deliver it to a separator wherein a rotatable spinner operates to induce a desired pattern of flow of the metal bearing fluid in a plating chamber, between an anode and a cathode. It has often been found in the use of this prior art apparatus that the silver extracted is relatively soft, a condition which does not insure that the silver will remain extracted from the solution during the separating cycle. Apart from this, in the operation of the rotating spinner heat is often produced to a degree that it upsets the chemical balance of the basic fixer solution in which the silver is embodied. This means that the fixer solution may not be reused.

Apart from the foregoing problems noted with reference to prior art systems and apparatus for recovering silver from a fixing solution, such prior art apparatus has been so constructed that when one desires to remove the silver which has been separated, fixer solution which is then in the separator may be lost. An additional problem found in use of the prior art separators of the type described is frequent malfunction due to deterioration of the electrical connections, particularly those required for energizing the anode and cathode.

Solution of all the noted problems was the objective of the efforts which resulted in the present invention.

Pursuant to Section 1.97 of Title 37 of the Code of Federal Regulations, as far as those substantively involved in the preparation of the present disclosure the most pertinent of the prior art publications is the U.S. Pat. No. 3,694,341. Another example of the prior art with which the invention is primarily concerned is found in U.S. Pat. No. 2,791,555.

SUMMARY OF THE INVENTION

In the case of the present invention electrical apparatus, a separator or recovery unit, apparatus for inducing flow of metal bearing fluid to and through the separator for extraction of its metal contents therein and appropriately related controls and gauges are all embodied in a small cabinet in a form in which the total may be readily connected into a film processing system, automatic or otherwise. The electrical apparatus is embodied in a circuit board having the form of a tray from which the various electrical components may be individually removed in servicing procedures. As a matter of fact, all of the components of the invention system are positioned and arranged in the cabinet for ready and convenient access to each, on an individual basis.

In the invention embodiment illustrated a pump means is provided for connection to the supply of metal bearing fluid, found in this case in the fixer tank of a film processing installation to which the invention apparatus is applied. This pump means provides a positive flow of the metal bearing fluid to the separator unit, which has no moving parts. The separator includes a manifold through which the metal bearing fluid is passed to a delivery tube, from which it is directed to a dome-shaped chamber having small bore passages in the walls thereof which produce a discharge of the fluid, in a helical pattern of flow, to one end of an annular separating chamber provided between an anode and a cathode which are fixed in concentrically spaced relation between capping end plates. The end plates simultaneously bridge the respective ends of a clear plastic tube which together therewith form a housing for the anode and cathode. The structural arrangement afforded in the separator provides for discharge of the fluid from the separating chamber to the manifold at a point where a portion of the fluid is drawn to and through a recirculation line by a second pump and returned by way of the manifold to the delivery tube in which it is mixed with further fluid entering directly from the fixing tank at the same time. A portion of the fluid cycled through the separating chamber is directed from the manifold back to the fixing tank in a "clean" condition. By "clean" it is meant that the condition of the fluid is such that essentially all the previously contained silver has been extracted therefrom. Per the invention, the recirculating pump increases the pressure head on the fluid subjected to the separating process and increases the speed of movement thereof through the separating chamber to a degree that the end results is a maximum separation of the contained silver and a deposit thereof as a hard plating on the cathode element.

The manifold and the end plates for the housing of the cathode and anode are designed for a simple interconnection and ready disassembly. Moreover the cathode is simply interconnected to one end plate of the housing so as; to permit its ready separation from its position within the housing, and without disturbance to or loss of such metal bearing fluid as might remain in the housing.

A feature of the illustrated embodiment of the invention is that the means for connecting a source of power to energize the anode and cathode are provided exterior to the separator housing and clear of any contained or circulated fluid.

Appropriate controls are provided to time the separating operation, as may be required by the nature and character of the film processing installation to which the invention apparatus is applied.

It is a primary object of the invention to provide a system and apparatus for the recovery of metal from a metal bearing solution which is economical to fabricate, more efficient and satisfactory in use, adaptable to a wide variety of applications and unlikely to malfunction.

A further object is to provide apparatus for recovery of metals from a metal bearing solution having particular advantage in application to the recovery of silver from a fixing solution utilized in a film processing installation.

Another object is to provide apparatus for separating metal from a metal bearing solution utilizing an electrolytic action featuring a separator in which there are no moving parts.

An additional object is to provide for the recovery of metal from a metal bearing solution utilizing an electrolytic action which enables the deposit of the metal as a relatively firm plating on a cathode element.

A further object is to provide an improved separator for extracting metal such as silver from a metal bearing solution featuring a separator having no moving parts wherein the fluid is circulated and, at least in part, recirculated between an anode and cathode to produce a pressure head thereon which induces removal of its contained metal at a rapid rate and under conditions which leave the fluid in a relatively "clean" reusable condition.

Another object is to provide an improved means and method for extracting silver from a solution such as a fixer solution used in a film processing installation.

An additional object of the invention is to provide improved means and methods for extracting silver or a like metal from a solution possessing the advantageous structural features, the inherent meritorious characteristics and the means and mode of use herein described.

With the above and other incidental objects in view as will more fully appear in the specification, the invention intended to be protected by Letters Patent consists of the features of construction, the parts and combinations thereof, and the mode of operation as hereinafter described or illustrated in the accompanying drawings, or their equivalents.

Referring to the accompanying drawings wherein is shown one but obviously not necessarily the only form of embodiment of the invention, FIG. 1 is a flow diagram illustrating an embodiment of the system of the present invention;

FIG. 2 is a partially exploded generally diagrammatic view of a recovery unit per the present invention;

FIG. 3 is a view taken on line 3—3 of FIG. 2, shown in a generally diagrammatic fashion;

FIG. 5 is a vertical cross section of the separator device showing its components in an assembled form;

FIG. 6 is a sectional view taken on line 6—6 of FIG. 5; and

FIG. 7 is a top plan of the distributor base embodied in the structure of FIG. 5.

Like parts are indicated by similar characters of reference throughout the several views.

Figure 4:
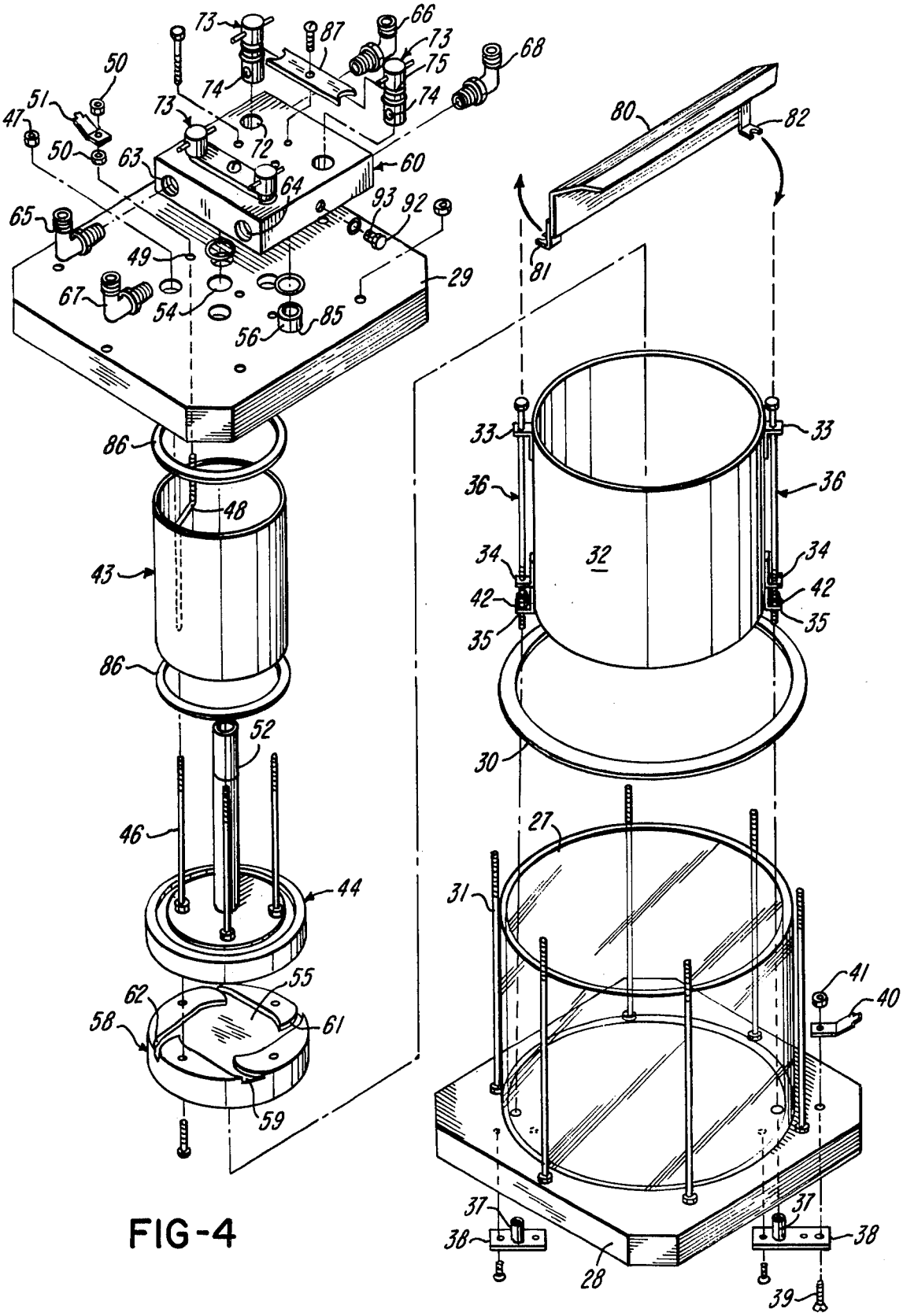
FIG. 4 is an exploded view illustrating details of the essential components of the separator device.

The invention is illustrated as embodied in a system for the automatic processing of X-ray film wherein silver particles originally present in a coating on the film tend in use of the system to accumulate in the fixer solution. As diagrammatically illustrated, this solution is contained in a tank 10. For silver recovery purposes, the fixer solution is withdrawn from the tank 10 by way of a delivery line 11, circulated through a recovery unit 12 and returned to the tank in an essentially metal free condition, for reuse, by way of a return flow line 13. Intermediate the tank 10 and the recovery unit 12, the lines 11 and 13, which extend in side by side relation, are bridged by and have included therein a valve 14. The valve 14 is a conventional valve which in one position of its adjustment permits free passage of fluid to and from the recovery unit by way of the lines 11 and 13 and in another position blocks such flow. In the latter case the setting of the valve 14 provides that fluid may be continuously recirculated to and through the recovery unit in bypassing relation to the tank 10.

The unit 12 includes a relatively small, generally rectangular, cabinet structure 15 forming a housing the interior of which is divided by a horizontally oriented partition 17 into an upper compartment 18 and a lower compartment 19. The top of the cabinet is comprised of a removable cap-like lid which provides the top of the compartment 18.

A pair of motorized pump units 22 and 23, located in respectively diagonally opposite corners of the compartment 18, are mounted to have their pump portions project through apertures in the partition 17 to orient their motor drive shafts perpendicular to the partition. The arranagement is such that their motor portions are accessible in the compartment 18 while their pumping portions are located in the compartment 19, presenting their inlets and outlets in accessible locations immediately below the partition 17. The pumping units are conventionally constructed and therefore not further described.

The end of the delivery line 11 remote from the tank 10 is thrust through an aperture 20 in the back wall 16 of the cabinet 15 and coupled to the inlet of the pump 22. An extension of the line 11 connects the outlet of the pump 22 to an inlet of a manifold 60 the nature and character of which will be further described. The end of the return line 13 remote from the tank 10 is thrust through a second aperture 21 in the back wall of the cabinet 15 and coupled to an outlet of the manifold 60.

Seated on and in covering relation to the upper surface of the partition 17 is an inverted tray 25 which has cutouts accommodating a projection therethrough of the pumps 22 and 23. The electrical componentry and the various circuits involved in the invention system are mounted to provide a consolidation thereof in connection with the tray 25. To service the same all one needs to do is remove the lid 91 and merely lift the tray from the compartment 18, at which point the total of the electrical system is totally accessible for examination.

A separator device 24 is seated within and on the bottom of the lower compartment 19, access to which may be had through a front opening in the cabinet 15 which is closed by a door D.

The separator 24 includes a housing comprised of a clear plastic tube 27 one end of which is bridged and capped by a base plate 28, connected by cement to form a seal therebetween, and the other end of which is capped by a top plate 29. A rubber-like sealing ring 30 seated in a circular recess in the under surface of the plate 29 positions between this plate and the upper edge of the tube 27 when the plate 29 is applied. The reference to "top" and "bottom" is with regard to the orientation of the separate device as shown in the accompanying drawings.

The plates 28 and 29 are so dimensioned as to project peripherally of and to form a flange at each end of the tube 27. These flanges are placed thereby in parallel spaced relation and interconnected by tie bolts 31. The lower ends of the tie bolts are suitably anchored to project perpendicularly to and upwardly from the base 28 in a circularly spaced relation. The upper threaded extremities of the bolts 31 project through aligned apertures in the plate 29 above which nuts threaded thereon are so applied as to clamp the plate 29 in a sealing capping relation to the top of the tube 27.

A stainless steel cathode element 32, which has a tubular form and cylindrical configuration, is seated on the plate 28, within and in a concentrically spaced relation to the tube 27. The length or vertical extent of the cathode element 32 is slightly less than that of the tube 27. Fixed on the outer surface of the cathode 32, in a longitudinally aligned relation and at each of diametrically opposite locations, is an upper radially projected apertured guide lug 33 and a pair of lower similarly projected apertured guide lugs 34 and 35 which are in an adjacent but spaced relation.

Thrust through each of these sets of guide lugs 33, 34 and 35, from the upper end thereof, is an elongate headed bolt 36 the length of which is greater than the axial length of the cathode element 32. The lowermost end of each bolt 36 is threadedly engaged in a metallic sleeve-like nut 37 positioned within an aperture in the base plate 28. The sleeve-like nut 37, in each case, is welded to and projects perpendicularly from a narrow elongate electrically conductive plate 38 nested in a recess in the bottom of the plate 28, secured by a screw.

The pair of plates 38 are diametrally spaced and positioned to project in a sense radially of the cathode element. Their outermost ends extend outwardly and radially beyond the tube 27. A metal screw 39 thrust through an aperture in the outermost end of one of the plates 38, to have its head seat against its bottom, projects through an aligned aperture in the plate 28 and upwardly therefrom to and through an aperture in one end of a strip-like electrically conductive connector element 40 above which it is threadedly engaged by a nut 41. Turning down the nut 41 clamps the element 40 to the upper surface of the plate 28 to hold the head of the screw 39 in a firmly contacting conductive relation to the related plate 38.

Threadedly engaged about each bolt 36, between the lugs 34 and 35 through which it projects, is a pair of nuts 42. As the latter are turned down and seated against the lowermost lugs 35, they cause the cathode element 32 to seat in a firmly abutted relation to the upper surface of the plate 28.

By the arrangement here provided the connector element 40 is conductively related and provides a means for connecting a source of electrical energy to the cathode element 32.

A stainless steel anode element 43 is connected to depend perpendicular to and from the center of the undersurface of the plate 29. A ring type seal is interposed between these elements. The lower end of the anode 43 is capped by a disc-shaped element 44 which has a central aperture 45 and is formed of a plastic material. A ring type seal 86 is also interposed between the lower end of the anode 43 and the disc 44.

A series of circularly spaced tie bolts 46 have their lowermost ends threadedly engaged in a fixed by applied nuts to the disc 44. The bolts 46 project upwardly from the disc 44 to extend adjacent the interior wall surface of the anode and have their upper threaded ends project into aligned apertures in the plate 29. These apertures are counterbored at the ends thereof which open from the uppermost surface of the plate 29. The upper ends of the tie bolts which are located in these counterbores are threadedly engaged by nuts 47. As the nuts 47 are turned down on the bolts 46, they pull the bolts and the disc 44 upwardly whereby to clamp the upper end of the anode based thereon to the undersurface of and perpendicular to the plate 29.

Welded to the inner surface of the anode element 43 to extend upwardly from the lower end and substantially the length thereof, in contact therewith, is an electrically conductive rod 48. The uppermost end of the rod 48 is slightly offset in a sense inwardly of the anode and extends upwardly therefrom to project to and through an aperture 49 in the plate 29. The uppermost end of the rod 48 is threaded and projects slightly above the plate 29 where it is first threadedly engaged by a metallic nut 50, then projects through an aperture in one end of a strip-like electrically conductive connector element 51, following which it is threadedly engaged by a second nut 50. As will be obvious the nuts 50 are appropriately turned down on the projected extremity of the rod 48 to clamp the connector element 51 therebetween and to mutually clamp and secure the rod 48 in a fixed position with reference to the plate 29. As will be obvious the connector device 51 affords means whereby a source of electrical power may be connected to the anode 43 by way of the rod 48.

Fixed by a sealing cement to project perpendicularly to and in a sense upwardly from the disc 44, with its lower end in a rimming relation to the aperture 45, is a delivery tube 52. With the disc 44 assembled and connected in a suspended relation to the plate 29 as above described, the tube 52 positions within and in concentric spaced relation to the anode 43 and projects upwardly therefrom to and through a central aperture 54 in the plate 29. The length of the tube 52 is such that it projects slightly above the uppermost surface of the plate 29 and at the point where it so projects it is rimmed by an O-ring the purpose of which shall soon become obvious. The plate 29 has a further aperture 85 which is radially spaced from the aperture 54 to position in an outwardly spaced relation to the anode 43 and to open to an area radially centered between the anode and the cathode 32 when these parts are assembled to the plate 29 as described. Cemented within the aperture 85 is the lowermost end of a short plastic tube segment 56 the opposite end of which projects, to a limited degree, upwardly from and perpendicular to the upper surface of the plate 29 in a parallel relation to the projected portion of the tube 52.

As will be seen from the foregoing, with the plates 28 and 29 assembled in their capping relation to the tube 27 and interconnected by tie bolts in simple fashion, the anode 43 which is fixedly connected to depend from the plate 29 positions within and in concentrically spaced relation to the inner surface of the cathode element 32 and the lower end of the anode is based on the disc 44 the undersurface of which is in vertically spaced relation to the plate 28.

The lowermost surface of the disc 44 is provided at its center with an arcuate hollow or concavity forming a dish shaped recess 53 opening through the center or apex of which is the aperture 45.

Connected in capping relation to the lowermost surface of the disc 44 is a disc-shaped plate 58 the outer periphery of which is sized similarly to that of the disc 44. The discs 44 and 58 are connected by screws. The disc 58 has a shallow cylindrical recess 55 in that portion of its surface which faces the recess 53. That portion of the disc 58 which rims the recess 55 is formed with four circularly and equidistantly spaced generally arcuate and somewhat radially oriented grooves 59. As seen in FIG. 7 of the drawings, each groove 59, in a clockwise sense, has the one side wall 61 thereof formed on a generally uniform arc and the other side wall 62 thereof formed on a line generally tangential to the wall surface rimming the recess 55. The arrangement is such to produce a configuration of each groove 59 giving it a relatively wide entrance mouth communicating with the recess 55, outwardly of which the side walls of the groove 59 converge to form a relatively narrow throat followed by a radially outermost portion of the groove the side walls of which slightly diverge. As the disc 58 is secured by screws in facing covering relation to the lowermost surface of the disc 44, the outer peripheral portion of the lowermost face of the disc 44 which bounds the recess 53 serves as a closure for the open sides of the grooves 59, converting the same thereby into jet-like discharge passages the inner ends of which communicate with the dome-shaped chamber formed by the mating recesses 53 and 55 and the outer ends of which open to the area between the lower ends of the concentrically spaced anode and cathode elements.

Seating on and in connection with the uppermost surface of the plate 29 is a manifold block 60 which has a rectangular configuration. The block 60 has parallel through bores, respectively 63 and 64. Each of the opposite ends of the bore 63 is counterbored and the wall portion bounding each counterbore is threaded. Threadedly engaged in the counterbore to one end of the bore 63 is one end of an elbow shaped tubular fitting 65. Threadedly engaged in the counterbore in the opposite end of the bore 63 is one end of an elbow shaped tubular fitting 66. The respective ends of the bores 64 are formed similarly to the comparable portions of the bore 63. One counterbored end of the bore 64 most adjacent the fitting 65 has threadedly engaged therein one end of an elbow shaped tubular fitting 67. The opposite counterbored end of the bore 64 has engaged therein one end of an elbow shaped tubular fitting 68. A flexible tubular conduit (11) is coupled at one end thereof to the outlet of the pump 22 while its opposite end is appropriately coupled to the outermost end of the fitting 65.

The bore 63, at a location centered between its respective ends, is intersected by cylindrical recess 70 formed in the undersurface of the manifold block 60.

The diameter of the recess 70 is such that it accommodates the upwardly projected extremity of the tube 52 with a slight friction fit as the block 60 is mounted to the top of the plate 29. In the application of block 60 the ring seal about the projected extremity of the tube 52 is clamped and compressed between the block and the plate 29 as well as about the joint between the tube 52 and the plate 29.

The bore 64 is intersected, at a location intermediate its ends, by a cylindrical recess 71 also formed in the under surface of the block 60. The diameter of the recess 71 is the same as that of the recess 70 and this recess is adapted, as the block 60 is mounted on the plate 29, to receive therein, with a slight friction fit, the upwardly projected end of the tube segment 56. An O-ring type seal is also applied about the tube segment 56, to position between the block 60 and the plate 29.

Each of the bores 63 and 64 are intersected by two additional cylindrical recesses 72 which are formed in the uppermost disposing surface of the block 60, respectively to either side of the recess 70 or 71 and between such recess and the respective ends of the bore it intersects. Each recess 72 has mounted for rotation therein the cylindrical body portion of an on-off valve 73 which includes a single diametral through aperture 74 which in one position thereof permits flow through the portion of the bore which it intersects and in another position thereof, as will be obvious, blocks flow. Each of the valves 73 have their cylindrical body portion extended upwardly of and from the outwardly disposing surface of the block 60, immediately of which each has a circumferential groove 75.

As the valves 73 mount in the block 60, they are paired in a transversely spaced relation. Releasably interposed between each such pair, in a manner evidenced in FIG. 4 of the drawings, is a strip-like plate 87 each of the respective ends of which has a notch to accommodate and nest therein, essentially precisely, that reduced diameter portion of one of the valve elements 73 which forms therein its groove 75. Thus each plate 87 bridges a pair of the valves 73 and has its respective extremities projected in their grooves 75, between the side walls of such grooves. Each plate is secured to the block 60 by a screw, under which conditions the valves 73 are contained in and for rotation with respect to the block to serve the function of blocking flow through segments of the manifold if and when required. A rod-like operator element 76 thrust through a diametral aperture in the upper projected end portion of each valve body 73 facilitates the rotation of these valves should the same be necessary.

The block 60 also has a small bore opening in one side thereof the innermost end of which opens to the recess 71. The wall of this small bore is threadedly engaged by the body of the screw 92 which has a longitudinal groove 93. On suitable adjustment of the screw 92, the passage afforded by the groove 93 may be used to bleed air from the circulating system of the invention to the surrounding atmosphere in a manner believed obvious.

Referring to FIG. 5 of the drawings, it will be seen that as the manifold block 60 seats in its assembled relation to the plate 29, the projected extremities of tubes 52 and 56 reach only to the lower levels of the bores intersected by the recesses in which they nest and the base or innermost surface of each recess positions immediately above such bores. Also, once mounted, the block 60 is secured to the plate 29 by screws.

Referring to FIG. 4 a supplemental tool 80 is provided comprised of a length of a right angled plate, one leg of which disposes horizontally in use thereof and the other depends vertically. The latter leg has connected to each of its respectively opposite faces, at respectively opposite ends thereof, a perpendicularly projected lug-like device 81, 82 the outer end of which has a notch sized to receive therein the body portion of a bolt 36 which is immediately under its head. From the construction of the separator here provided, it will be seen parts are interconnected by simply disengaged bolts and/or units. Upon removing the nuts at the upper ends of the bolts 31, the plate 29, the manifold 60, and the anode 43 together with their interconnected structure may be lifted from the housing tube 27 and the contained cathode 32. Unscrewing bolts 36 frees the cathode from base plate 28. Applying tool 80 in a rotative fashion to have the notched lugs 81, 82 engage diametrically opposite tie bolts immediately under their heads provides an engagement of the lugs in supporting relation to the heads. On lifting the tool 80, once so placed, the cathode element can be cleanly and swiftly removed without disturbance to or loss of any solution then in the separator housing.

Thus, when the cathode is adequately plated in a recovery operation, the system can be shut down, the cathode removed and silver in the form applied per the present invention readily removed also. Replacement of the cathode is also quick and simple.

Maintenance is equally facilitated by the construction here provided.

In the use of the system and apparatus of the invention above described the lines 11 and 13 will be connected to open into the tank 10 embodying the fixer solution from which the silver must be separated. As noted previously, there are suitable electrical controls and circuitry in connection with the tray 25 to energize the system, primarily to power the motors of the pumps 22 and 23 and to energize the anode and cathode elements embodied in the separator 24. Since the arrangement of the electrical components and circuitry is well within the skill of a mechanic versed in this art, such detail has not been described. Suffice it to say that upon closing of appropriate switch means, the control of which is made available at the front of the cabinet 15, the pumps 22 and 23 as well as the anode and cathode elements of the separator are energized.

On energizing thereof the pump 22 draws the silver bearing fixer solution from the tank 10 and delivers it to the cylindrical recess 70 in the manifold block 60. Note that both the recess 70 and the recess 71, which are equal in size, have cross sectional dimensions substantially larger than those of the bores 63 and 64, as does the tube 52. The upper end of the tube 52 nests and projects in the recess 70 only to the lower level of the bore 63 which it intersects. Thus, as fluid passes through the fitting 65 from the line 11 into the bore 63 and through the adjacent valve 73 therein which is then open, it enters the recess 70 and inherently drops through its open bottom to and through the tube 52, under the influence of the pressure head provided by the pump 22 but primarily under the influence of gravity.

As the silver bearing solution exists from the tube 52 it enters and hits the base of the distributing chamber between the discs 44 and 58 and discharges from this chamber in tangential jet-like flows by way of the passages produced by the capping of grooves 59. The doom-like character of the distributing chamber comprised of the recesses 53 and 55 enables that the fluid entering the same will develop a smooth non-pulsating flow pattern the velocity of which is accelerated as it moves outwardly by way of the specially configured passages 59. By reason of its accelerated tangential discharge the silver bearing fluid has a spiral flow pattern as it enters the lower end of the space between the anode 43 and the cathode 32. This pattern is continued as the fluid is caused to move upwardly, in a spirally flowing column, between the anode and the cathode elements to the plate 29. Under the influence of the head of pressure thereon the fluid then enters the recess 71 intersecting the bore 64. The fluid within the recess 71 is subjected to the suction applied thereto by the pump 23. The pump 23 operates to draw a substantial portion of the fluid from the recess 71 and to deliver it in recirculating fashion, under the influence of the pressure head which it applies thereon, back to the recess 70 where it mingles with fluid being directed to this recess at the same time, from the tank 10, under the influence of the pump 22. The valve 63 between the pump 23 and the recess 70 is, of course, open, as are all the valves 63 during normal operation of the invention system.

It will be seen at this point that the silver bearing fluid moving through the tube 52 will be subjected not only to the pressure head developed thereon by the pump 22 but the additive pressure head developed thereon by the recirculating pump 23. With this arrangement it has unexpectedly been found that the flow of fluid through the tube 52, the distributing chamber to which it opens at its lower end and the jet-like flow passages exiting tangentially of this chamber is such that the movement of the fluid upwardly of and between the anode and cathode is extremely rapid. While it cannot be explained, it has been found that with this flow under the circumstances and conditions described and the electrolytic action resulting as the anode and cathode are energized, silver is rapidly extracted from the fluid and is deposited on the cathode element as a relatively firm and hard plating.

As noted previously, in operation of the system only a portion of the fluid reaching the recess 71 is recirculated under the influence of the pump 23. The remainder is returned to the tank 10 by way of the flow line 13.

It has been found, in extensive tests, that the fluid returned to the tank is essentially clean of silver content as an end result of the use of the described system. The fluid is therefore given a longer life. Not only this, the quality of the silver deposited on the cathode has been found to be in the best possible condition for salvage material. It is accordingly more valuable a silver than that extracted in the use of prior art systems and apparatus applied to the same purpose. In addition a greater quantity of silver is recovered from a given solution than heretofore possible. Thus, three important achievements are inherent in use of the invention. Take particular note that in the case of the present invention there are no moving parts in the separating or distributing chambers to overheat and deteriorate the metal bearing solution in the process of their required function.

From the foregoing, the simplicity as well as the benefits of the present invention are believed clearly apparent. Not the least of the benefits is the structural features enabling the application of a simple lifting device such as the element 80 to hook under the heads of the tie bolts holding the cathode element in place once they are unscrewed from the base 28, following the simple removal of the top plate 29 and its supported structure, to lift the cathode free and clear of its housing.

As a matter of fact, simplicity and economy of fabrication, maintenance and use should be readily apparent from the manner in which the total of the separator apparatus parts are interconnected.

The present invention therefore provides improvements in and answers important needs in the art described. While the invention apparatus is especially advantageous for use in salvaging silver as applied to film developing installations, it should nevertheless be clear that the invention concepts have utility for similar purposes in other installations.

From the above description it will be apparent that there is thus provided a device of the character described possessing the particular features of advantage before enumerated as desirable, but which obviously is susceptible of modification in its form, proportions, detail construction and arrangement of parts without departing from the principle involved or sacrificing any of its advantages.

While in order to comply with the statute the invention has been described in language more or less specific as to structural features, it is to be understood that the invention is not limited to the specific features shown, but that the means and construction herein disclosed comprise but one of several modes of putting the invention into effect and the invention is therefore claimed in any of its forms or modifications within the legitimate and valid scope of the appended claims.

The embodiments of the invention in which an exclusive property or privilege is claimed are defined as follows:

1. Metal recovery apparatus including a separating unit comprising a housing, anode and cathode elements mounted to position in a spaced relation interiorly of said housing, distributor means defining a flow path for directing a metal bearing solution received by said housing to flow between said anode and cathode elements, in the process of which said anode and cathode elements when energized function to produce a movement of metal contained in said solution to deposit on said cathode element, said flow path being free of moving parts, means defining an inlet to said flow path arranged for connection thereof to a source of metal bearing solution and an outlet from said flow path, and said distributor means comprising a tube terminating in means defining a distribution chamber having jet-like exits to the space defined between said anode and cathode elements and the space between said anode and cathode elements being in open communication with said outlet.

2. Metal recovery aparatus as in claim 1 wherein said distributor means is formed to cause said solution to move between said anode and cathode elements in a spiraling helical type flow pattern within which said cathode element is positioned.

3. Metal recovery apparatus including a separating unit comprising a housing, anode and cathode elements mounted to position in a spaced relation interiorly of said housing, distributor means within said housing defining a flow path for directing a metal bearing solution received by said housing to flow between said anode and cathode elements, in the process of which said anode and cathode elements when energized function to produce a movement of metal contained in said solution to deposit on said cathode element, said flow path being free of moving parts and said distributor means being formed to cause said solution to move between said anode and cathode elements in a spiral helical type flow pattern within which said cathode element is positioned, said housing including an outlet defined by means through which the solution subsequent to passing between said anode and cathode elements may be directed for recovery and an inlet for delivery of said solution to said distributor means, and means connected to said outlet for drawing a portion of the solution received therein and recirculating it back to said inlet under conditions applying a supplemental pressure head for the thus recirculated solution which intermingles with additional solution delivered to said inlet to pass to and through said distributor means and provide for a pressure head on the solution moving to and through said distributor means which increases the velocity of the solution as it is directed thereby through said flow path and between said anode and cathode elements.

4. Apparatus as in claim 1 wherein said anode and cathode elements are releasably anchored to separate portions of said housing by holding means at least a portion of which are electrically conductive and connected to electrically conductive connector means located exteriorly of said housing and free and clear of the flow path for the solution within said housing.

5. Metal recovery apparatus including a separating unit comprising a housing, anode and cathode elements mounted to position in a spaced relation interiorly of said housing, distributor means within said housing defining a flow path for directing a metal bearing solution received by said housing to flow between said anode and cathode elements, in the process of which said anode and cathode elements when energized function to produce a movement of metal contained in said solution to deposit on said cathode element, said flow path being free of moving parts, said cathode element being connected to said housing by bolts providing means for extracting the cathode element and positioning it free and clear of said housing without material disturbance to the solution, if any, which may be contained in said housing at that time.

6. Apparatus as in claim 5 including means rotatably applicable to portions of the bolts to engage thereto and serve as a means for lifting the cathode element from said housing.

7. Metal recovery apparatus including a separating unit comprising a housing, anode and cathode elements mounted to position in a spaced relation interiorly of said housing, distributor means within said housing defining a flow path for directing a metal bearing solution received by said housing to flow between said anode and cathode elements, in the process of which said anode and cathode elements when energized function to produce a movement of metal contained in said solution to deposit on said cathode element, said flow path being free of moving parts, said housing including a tube-like peripheral wall bridged at one end by a base and the opposite open end of said peripheral wall being capped by means supporting said anode element to position interiorly of said housing and in spaced relation to said base and said cathode element being positioned about and in concentrically spaced relation to said anode element.

8. Metal recovery apparatus including a separating unit comprising a housing, anode and cathode elements mounted to position in a spaced relation interiorly of said housing, distributor means within said housing defining a flow path for directing a metal bearing solution received by said housing to flow between said anode and cathode elements, in the process of which said anode and cathode elements when energized function to produce a movement of metal contained in said solution to deposit on said cathode element, said flow path being free of moving parts, said housing including means defining an inlet to said flow path arranged for connection thereof to a source of metal bearing solution and an outlet from said flow path, and said distributor means comprising a tube positioning within said projecting through said anode terminating in means defining a distribution chamber having jet-like exits to one end of the space defined between said anode and cathode elements, which elements are positioned in concentrically spaced relation, the opposite end of said space being in open communication with said outlet.

9. Apparatus as in claim 8 wherein said jet-like exists are configured to produce a swirling helical flow of solution from said distributor means to one end of said space between said concentrically positioned elements.

10. Apparatus as in claim 9 wherein said distribution chamber is a domed chamber and said tube has the discharge end thereof open to said distribution chamber through the apex thereof.

11. Metal recovery apparatus including a separating unit comprising a housing, anode and cathode elements mounted to position in a spaced relation interiorly of said housing, distributor means within said housing defining a flot path for directing a metal bearing solution received by said housing to flow between said anode and cathode elements, in the process of which said anode and cathode elements when energized function to produce a movement of metal contained in said solution to deposit on said cathode element, said flow path being free of moving parts, said housing having an inlet and an outlet, a manifold device being mounted to said housing having parallel through bores including intersecting recesses intermediate their ends, at least a portion of one of said bores being adapted to be interposed between said inlet and the source of fluid, the intersecting recess in said one of said bores being communicated with said inlet which forms an extension thereof, the other of said bores having an intersecting recess communicating with said outlet of said housing and adapted to have connected therewith a conduct means for delivery of essentially clean fluid from said housing after the extraction therefrom of said metal which is deposited on said cathode element.

12. Apparatus as in claim 11 wherein recirculating means are communicated with said intersecting recesses by way of portions of said bores to the side of said recesses remote from those portions of the bores which are adapted for communication with a source of fluid and a delivery conduit and said recirculating means embodies a pump for producing a supplemental pressure head on the fluid moved between said anode and cathode elements whereby to establish a velocity thereof which expedites the extraction of metal therefrom and the deposit thereof on said cathode element as a firm hard plating.

13. Metal recovery apparatus including a separating unit comprising a housing, anode and cathode elements mounted to position in a spaced relation interiorly of said housing, distributor means within said housing defining a flow path for directing a metal bearing solution received by said housing to flow between said anode and cathode elements, in the process of which said anode and cathode elements when energized function to produce a movement of metal contained in said solution to deposit on said cathode element, said flow path being free of moving parts, said housing being comprised of a base from which perpendicularly projects a tube-like peripheral wall structure the upper open end of which is bridged by a cap-like structure including an inlet to and an outlet from said housing, said distributor means forms a continuation of said inlet within said housing and comprises a tubular conduit projected from said cap-like structure to depend within an area of said housing central to its peripheral wall structure, said anode element being connected to said cap structure to depend within said housing in a spaced concentric relation to said tube and said cathode is releasably connected to said base to project therefrom in concentric spaced relation to said anode and the said distributor means is further comprised of means defining a chamber in connection with said tube having jet-like exit passages positioned to direct solution from said chamber to the space between said anode and cathode to the end thereof adjacent said base, the opposite end of which space is in direct and open communication with said outlet.

14. Metal recovery apparatus including a separating unit comprising a housing, anode and cathode elements mounted to position in a spaced relation interiorly of said housing, distributor means within said housing defining a flow path for directing a metal bearing solution received by said housing to flow between said anode and cathode elements, in the process of which said anode and cathode elements when energized function to produce a movement of metal contained in said solution to deposit on said cathode element, said flow path being free of moving parts, said housing being comprised of a base from which perpendiculrly projects tube-like peripheral wall structure the upper open end of which is bridged by a cap-like structure including an inlet to and an outlet from said housing, said distributor means forms a continuation of said inlet within said housing and comprises a tubular conduit projected from said cap-like structure to depend within an area of said housing central to its peripheral wall structure, said anode element being connected to said cap structure to depend within said housing in spaced concentric relation to said tube and said cathode is releasably connected to said base to project therefrom is concentric spaced relation to said anode and the said distributor means is further comprised of means in spaced, facing relation to the lower end of said tubular conduit for impact of the fluid thereon and distribution thereby to the space between said anode and cathode to the end thereof adjacent said base, the opposite end of which space is in direct and open communication with said outlet.

15. Metal recovery apparatus comprising a separator unit including a housing having an inlet thereto and an outlet therefrom and containing a cathode and an anode element in concentric spaced relation, said inlet being adapted for the connection thereof to a source of metal bearing fluid for delivery of said fluid to said inlet by a first pumping means, under a predetermined head of pressure, means for directing the fluid received by said inlet to one end of the space between said anode and cathode elements, to move the length of said cathode element to said outlet solely under the influence of the pressure head applied by the external pumping means, in the process of which the cathode element, when a source of elecrical energy is applied to said anode and cathode elements, will have deposited thereon, in a plate-like form, metal contained in said fluid, and means connected between said inlet and said outlet to recirculate at least a portion of the fluid reaching said outlet back to said inlet to intermingle with fluid being delivered to said inlet from said source and, in the intermingling thereof, to produce an increased pressure head on the fluid which causes the intermingled fluid to move rapidly between said anode and cathode elements, in the process of which metal is removed therefrom and deposited on said cathode element under conditions which leave the fluid essentially clean of said metal, as to that portion thereof which is recovered by way of said outlet.

16. Apparatus as in claim 15 wherein a manifold device is mounted to said housing having through bores including intersecting cavities, at least a portion of one of said bores being adapted to be interposed between said inlet and the source of fluid, the intesecting cavity in said one of said bores being communicated with said inlet which forms an extension thereof, an intersecting cavity in another of said bores being communicated with said outlet of said housing and adapted to have connected therewith a conduit means for delivery of essentially clean fluid from said housing after the extraction therefrom of said metal which is deposited on said cathode element.

17. Apparatus as in claim 16 wherein recirculating means are communicated with said intersecting cavities and said recirculating means embodies a pump for drawing fluid from said cavity communicating with said outlet and delivering the same back to said intersecting cavity in communication with said inlet to produce a supplemental pressure head on the fluid moved between said anode and cathode elements whereby to establish a velocity thereof which expedites the extraction of metal therefrom and the deposite thereof on said cathode element as a firm hard plating.

18. Apparatus as in claim 15 wherein an electrically conductive element is connected to said anode and extended from said anode through and to the exterior of said housing to mount an electrically conductive element for connecting a source of power to said anode.

19. Apparatus as in claim 15 wherein means separately connecting said anode and cathode to said housing include electrical conductive elements which extend to the exterior of said housing to provide means for connecting a source of power thereto.

20. Metal recovery apparatus, comprising a housing having apertures therein for insertion of flow lines leading from and to a source of metal bearing fluid, said housing having a partition separating the interior thereof into an upper compartment and a lower compartment, a separator device utilizing a principle of electrolytic action to separate metal from a flowing fluid located in said lower compartment, pump means mounted within said housing including drive motor portions disposed in the upper compartment and pumping portions projected into the lower compartment, a removable tray seated on said partition means in said upper compartment mounting the electrical apparatus required for operation of said pump means and said separator device and connected thereto by conductor means which are releasably attached, said pump means being interconnected with said separator device and adapted for connection to flow lines extended through said apertures communicating with the source of metal bearing fluid to provide for a circulation and a recirculation of the metal bearing fluid in said separating means in the process of which to extract metal from the fluid and deliver the resulting fluid from said housing in an essentially clean condition.

21. Apparatus as in claim 1 wherein said jet-like exits are configured to produce a swirling helical flow of solution from said distributor means to the space between said concentrically positioned elements.

22. Apparatus as in claim 21 wherein said distribution chamber is a domed chamber and said tube has the discharge end thereof opened to said distribution chamber through the apex thereof.

* * * * *

UNITED STATES PATENT AND TRADEMARK OFFICE

CERTIFICATE OF CORRECTION

PATENT NO. : 4,149,954

DATED : April 17, 1979

INVENTOR(S) : Terry L. Ransbottom

It is certified that error appears in the above-identified patent and that said Letters Patent are hereby corrected as shown below:

In the ABSTRACT, line 25, "in" is corrected to read -- is --;

Col. 5, line 58, " a " is corrected to read -- and --.

Col. 9, line 45, "doom" is corrected to read -- dome --.

Col. 12, line 58 (Claim 8, line 15), "said" is corrected to read -- and --.

Col. 12, line 65, (Claim 9, line 1) "exists" is corrected to read -- exits --.

Col. 13, line 9 (Claim 11, line 5) "flot" is corrected to read -- flow --.

Col. 13, line 25 (Claim 11, line 21) "conduct" is corrected to read -- conduit --.

Col. 14, line 15, (Claim 14, line 12) "perpendiculry" is corrected to read -- perpendicularly --.

Col. 14, line 15 (Claim 14, line 12) -- a -- is inserted following "projects".

UNITED STATES PATENT AND TRADEMARK OFFICE

CERTIFICATE OF CORRECTION

PATENT NO. : 4,149,954

DATED : April 17, 1979

INVENTOR(S) : Terry L. Ransbottom

It is certified that error appears in the above-identified patent and that said Letters Patent are hereby corrected as shown below:

Col. 14, line 24 (Claim 14, line 21) -- a -- is inserted following "in".

Col. 14, line 26 (Claim 14, line 23) "is" is corrected to read -- in --.

Col. 14, line 67 (Claim 16, line 5) "intesecting" is corrected to read -- intersecting --.

Col. 15, line 17 (Claim 17, line 10) "deposite" is corrected to read -- deposit --.

Signed and Sealed this

*Fourteenth* Day of *August 1979*

[SEAL]

*Attest:*

*Attesting Officer*

LUTRELLE F. PARKER

*Acting Commissioner of Patents and Trademarks*